United States Patent [19]

Lasenga

[11] Patent Number: 4,910,830

[45] Date of Patent: Mar. 27, 1990

[54] PROCESS FOR PRODUCING FIBROUS WEBS OF SUPERPOSED WEB LAYERS

[75] Inventor: Werner Lasenga, Duelmen, Fed. Rep. of Germany

[73] Assignee: Hergeth Hollingsworth GmbH, Duelmen, Fed. Rep. of Germany

[21] Appl. No.: 260,222

[22] Filed: Oct. 20, 1988

Related U.S. Application Data

[62] Division of Ser. No. 145,342, Jan. 19, 1988, Pat. No. 4,805,269.

[30] Foreign Application Priority Data

Jan. 22, 1987 [DE] Fed. Rep. of Germany ..... 3701745

[51] Int. Cl.[4] ..... D04H 1/70; D01G 15/46

[52] U.S. Cl. ..... 19/302; 19/106 R; 19/145.7

[58] Field of Search ..... 19/302, 106 R, 99, 296, 19/145.7, 145, 145.5

[56] References Cited

U.S. PATENT DOCUMENTS

| | | | |
|---|---|---|---|
| 1,683,812 | 9/1928 | Walsh | 19/106 R |
| 2,168,775 | 8/1939 | Hurst et al. | 19/302 X |
| 2,385,873 | 10/1945 | Melton | 19/302 X |
| 2,467,291 | 4/1949 | Brelsford et al. | 19/302 X |
| 2,987,779 | 6/1961 | Kawashima | 19/106 R |
| 3,012,289 | 12/1961 | Weber | 19/106 R |
| 3,645,814 | 2/1972 | Knoepfler et al. | 19/302 X |
| 3,905,864 | 9/1975 | Curry et al. | 19/302 X |
| 3,940,216 | 2/1976 | Hinckley | 19/302 X |
| 4,805,269 | 2/1989 | Lasenga | 19/106 R |

FOREIGN PATENT DOCUMENTS

| | | | |
|---|---|---|---|
| 537511 | 5/1955 | Belgium | 19/302 |

*Primary Examiner*—Werner H. Schroeder
*Assistant Examiner*—Sara M. Current
*Attorney, Agent, or Firm*—Cort Flint

[57] ABSTRACT

An apparatus and process for producing fibrous nonwoven fabrics of at least two superposed fibrous web layers of equal or different structure is disclosed by using at least two successively arranged cards (2, 5) in a card set, means for discharging the fibrous webs from the card or the like in one direction, the discharged fibrous web layers being fed to a finishing unit (15) such as a calendar and the like, each card being provided with at least one doffing point (3, 4; 3',4'). The improvement comprises a conveying means (7, 12) carried adjacent and following the doffing point which is tiltable upwardly or downwardly at a predetermined angle. Transport devices (8, 9, 13, 14, 16) are mounted above and beneath the cards in communication with conveying means for transporting discharged webs.

6 Claims, 5 Drawing Sheets

19
15
9
13
2
4
5
12
10
3
7
6
16
17

19
15
9
13
12
2
4
5
3
6
7
10
16
17

19
15
9
13
12
2
4
5
3
6
7
10
16
17

19
15
9
13
2
4
3
5
7
6
12
10
8
17
16

PROCESS FOR PRODUCING FIBROUS WEBS OF SUPERPOSED WEB LAYERS

BACKGROUND OF THE INVENTION

The invention relates to a process and apparatus for producing fibrous webs of at least two superposed web layers of equal or different structure by using at least two successively arranged cards. The fibrous web layers are discharged from the card or the like, and are supplied to a finishing or strengthening bonding unit, such as a calendar or the like.

It has been known, for doubling fibrous webs, to provide successively or side-by-side arranged cards for continuously supplying the fibrous webs to a common endless conveyor belt. The number of required cards is dictated by the required number of web layers. In the case of successively arranged cards, the machines are set up like a bridge above the conveyor belt. If the machines are arranged side-by-side, the fibrous web is deviated by about 90 degrees. There has been further known a card comprising a doffing point by which the fibrous web is subjected to multiple division, the divided web portions being discharged separately.

Devices for doubling and other devices for discharging fibrous webs side-by-side from one or more cards have in common that the order of superposed or side-by-side discharged fibrous webs remains unchanged in case of an existing machine assembly. It is possible to modify the fibrous web structure, if a plurality of machines or doffing points are available, in that the corresponding machine is exchanged against another. It is not possible, in one and the same assembly, to change the sequence of superposed or juxtaposed order of the fibrous webs without the need of completely converting the plant. In fact, concerning the layer position, a plant is conformed and adjusted to quite a specific product of multilayered fibrous webs. As a result thereof, the production of multilayered fibrous webs becomes rather inflexible.

It is the object of the invention to provide a process and apparatus in which it is possible, with the use of one and the same machine assembly, to change the sequence or positioning of multiple fibrous webs.

Another object of the invention is to provide a process and apparatus for quickly and reliably producing, by simple means, fibrous webs having a completely different structural design with respect to the layers formed from the fibrous webs.

SUMMARY OF THE INVENTION

The invention is characterized in that each web layer removed from a card or the like may be supplied selectively in a direction beneath or above the web layer of the next card. The possible selection of joining the fibrous webs may be made from two cards, each having one doffing point, or of a single card having two doffing points. The final nonwoven fabric may be selected as desired, without changing the machines or doffing points. A flexibility concerning design and configuration of the final nonwoven fabric is provided. Preferably, at least two cards are used from which at least three fibrous webs are removed. In case of a final nonwoven fabric consisting of three layers, the structure flexibility of the ordering of individual layers is considerable. It is still more advantageous in case of two or three or even more successively provided cards, if some or each of the latter is provided with to doffing points. The further travel of the fibrous webs to move either above or beneath the fibrous web or webs of the preceding card may be optionally selected. Any desired layer sequence of the final web may be achieved without a substantial expenditure. A great number of product combinations is obtainable this way with one and the same machine line.

According to another feature of the invention, the web layer from each card may be optionally discharged opposite to the successive card arrangement. The web layer may be fed to a finishing point or the like set up in the opposite direction. By this means, operation may be had in two directions. Variations in the combination of the order of fiber layers in the final nonwoven fabric may be increased substantially. Further, economy of the system in total may be considerably improved.

Due to a further feature of the invention, the fibrous web removed from a card or the like may travel forward above the next card. Hence, all possible paths are favorably employed in order to fully utilize and increase the variety of combinations concerning the order of layers formed in the final nonwoven fabric.

The first card, and/or the second card, may be used together with more than one doffing means. It is also possible to provide among the successively arranged cards at least one for the random web type. The final nonwoven fabrics may comprise webs having fibers positioned in parallel and webs with randomly distributed fibers in a layer sequence optionally mixed at choice.

The combination of the fibrous web order in a final nonwoven product may be realized simply by providing a conveying means such as a belt following the doffing point of the card which may be swivelled angularly in an upward or downward direction. The conveying means lead to transport devices arranged above and below the cards which may be driven optionally to rotate in each longitudinal direction. In this case, both ends of the machinery set are provided with respective finishing points. The transport devices and conveying means following one doffing point may rotate in opposite senses. No additional rerouting unit is required in this case.

Apparatus for the production of fibrous webs having at least two superposed web layers of an equal or different structure may advantageously include, for example, two or more cards in succession. There is a finishing device at each end of the card set. There are two respective doffing means at each card, and a pivotable conveying means for the upper doffing point. Upper transport devices are arranged above the next card and there is a lower transport device below the cards adapted to be driven in both longitudinal directions. With this design, a plurality of high-quality end products may be produced in a sandwich arrangement including different structures in superposed order. There is no need for exchanging the machines or conveying means. Further, in the case of failure of a card in the set, the direction of the fibrous webs to be discharged may be easily changed and the fibrous webs are supplied in the desired order to the finishing point positioned at the opposite end of the card set.

The invention offers a high flexibility for the production of nonwoven fabrics comprising fibrous web layers in a varying sequence, and for the structure of the material. The same assembly may be used to produce a large number of variations of nonwoven fabrics composed of several fibrous web layers. The structural expenditure is low and the required conversion is realized quickly.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

Figure 5:
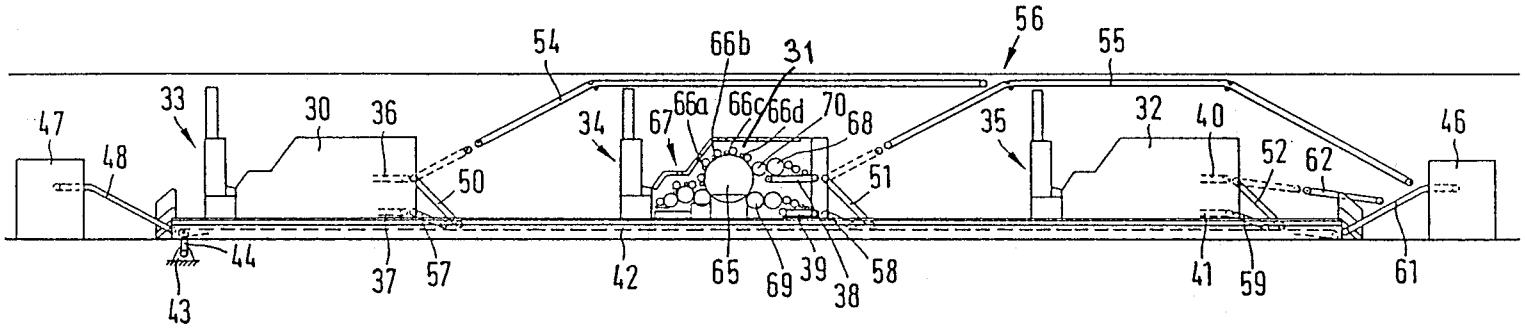

FIGS. *2a, 2b,* and *2c* illustrate schematically three positions of another embodiment of the apparatus and process in which one card comprises three doffing points;

FIGS. *3a, 3b, 3c,* and *3d* illustrate four positions of another embodiment of the invention in which a card has two doffing points, and two finishing points;

FIGS. *4a, 4b, 4c, 4d, 4e,* and *4f* illustrate schematically six different positions of another embodiment of the invention comprising two cards having two doffing points each, and two finishing points; and FIG. 5 shows a longitudinal section of a preferred embodiment comprising three cards having two doffing points each, and two finishing stations.

DESCRIPTION OF A PREFERRED EMBODIMENT

Figure 1:
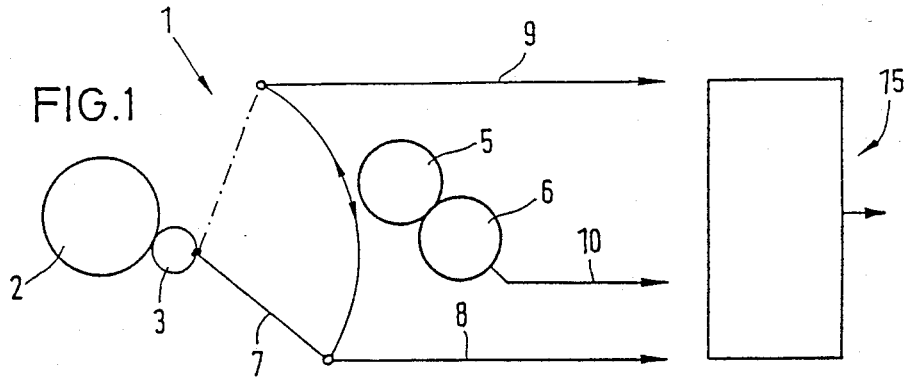
FIG. 1 is a schematic illustration of a simple design of the apparatus and process of the invention.
Figure 2A:
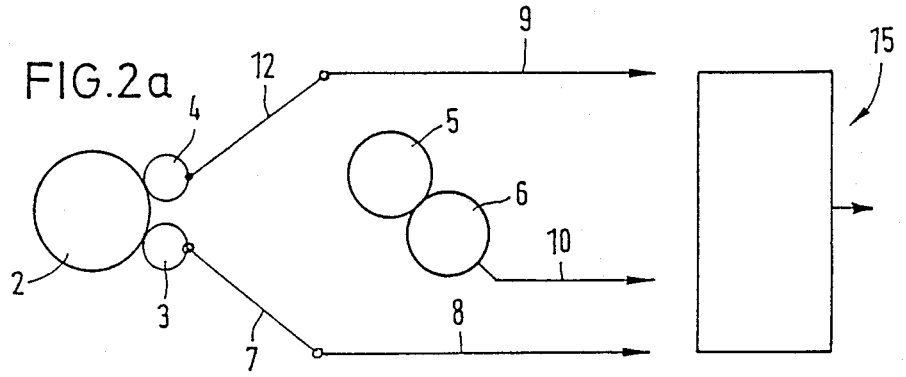
Figure 2B:
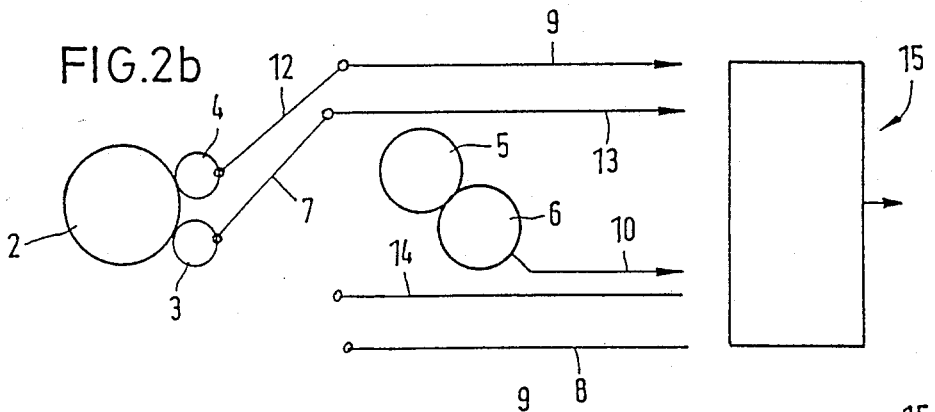
Figure 2C:
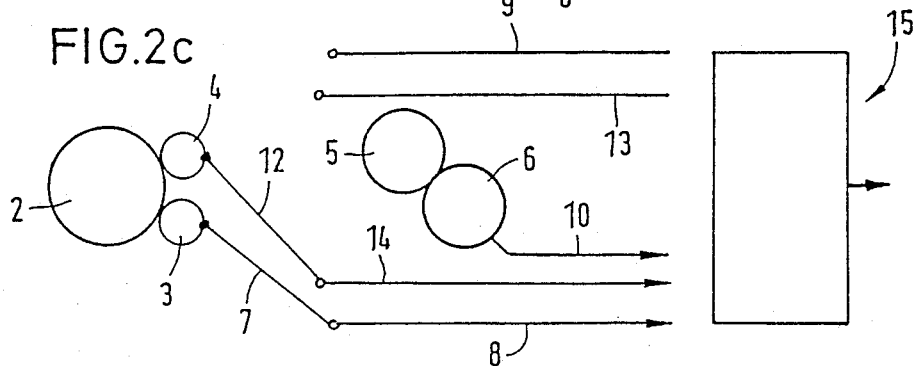
Figure 3A:
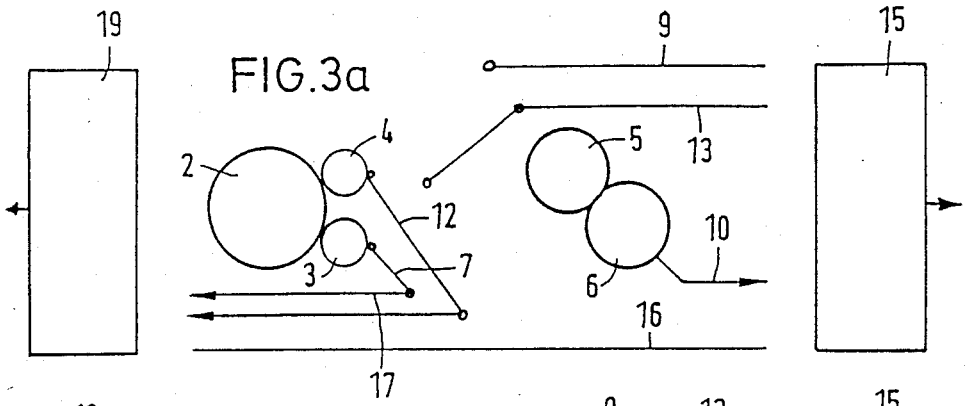
Figure 3B:
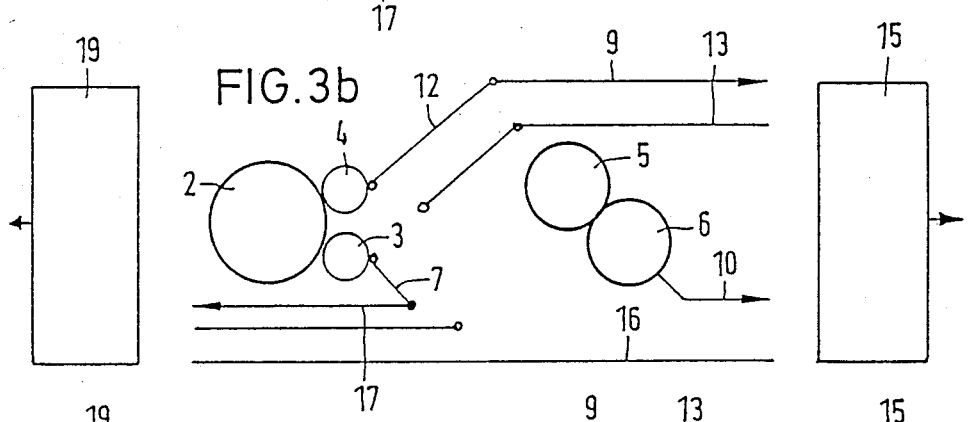
Figure 3C:
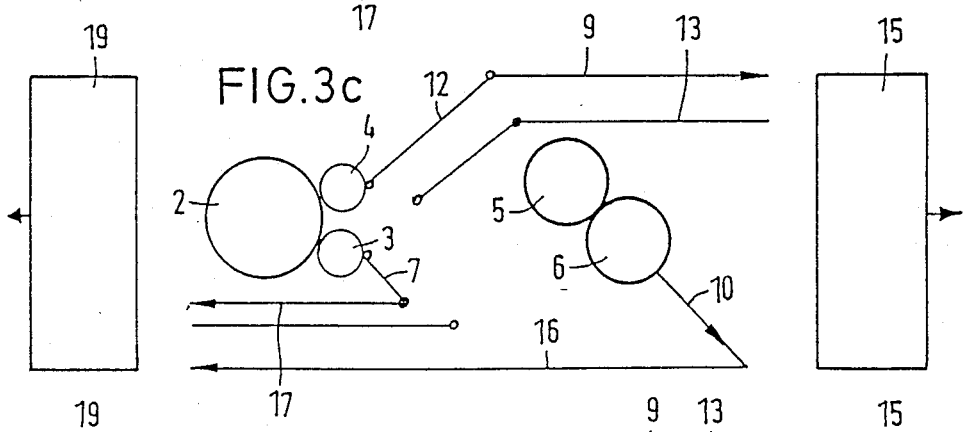
Figure 3D:
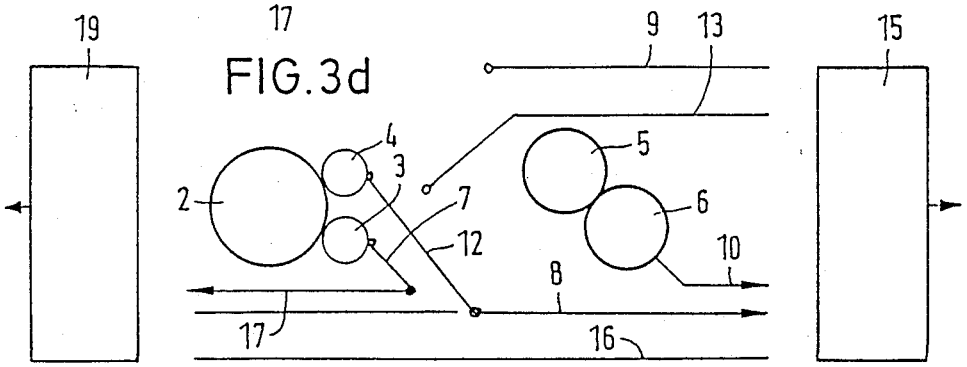

Referring now in more detail to the drawings, FIG. 1 illustrates two cards 2 and 5 arranged successively provided with respective doffing points 3, 6. A conveying means 7 is joined to doffing point 3 of card 2. Conveying means 7 is tiltable at a predetermined angle and adapted to be moved optionally to communicate with further transport devices 8 and 9. Card 5 has a doffing point 6 and a conveying means 10. A finishing unit 15 is arranged downstream of the card set 2, 5. Finishing unit 15 may consist of any conventional bonding means which, for instance, operates in a dry process (e.g. mechanically and/or thermally) or in a wet process. Transport device 8 is positioned beneath card 5, 6 while the further transport device 9 is located above card 5, 6. Both additional transport devices extend to the common finishing unit 15 where the fibrous webs are taken together and superposed. Upon bonding, the webs are discharged for further treatment. If the tiltable conveying means 7 communicates with transport device 8, a nonwoven fabric is obtained whose upper layer originates from card 5, 6 while its lower layer is supplied from card 2, 3. If the tiltable conveying means 7 communicates with upper transport device 9, a resultant nonwoven fabric is formed with a reverse order of fibrous webs in which the layer from card 2, 3 is above that from card 5, 6.

The assembly according to FIGS. *2a, 2b,* and *2c* comprises a card 2 having two doffing points 3 and 4. Card 5, 6 remains unchanged and is provided with a transport device 10. All fibrous webs are conveyed towards the common finishing unit 15. Upper doffing point 4 of card 2 is provided with a tiltable conveying means 12. Lower doffing point 3 of the card is provided with tiltable conveying means 7. Further, the system comprises upper transport device 9 positioned above card 5, 6 and lower transport device 8 is arranged beneath the card system.

FIG. *2a* shows conveying means 12 connected to upper doffing point 4 and with upper transport device 9. Conveying means 7 mounted at lower doffing point 3 communicates with transport device 8. Thus, in the finishing unit, the order of the fibrous webs in the nonwoven fabric may be 2, 4; 5, 6; and 2, 3.

In the embodiment of FIG. *2b,* both conveying means 7 and 12 are swivelled upwardly and connected to transport devices 9 and 13. The doffing point 6 of card 5 communicates With transport device 8. In this case, the order of the fibrous webs of the final nonwoven fabric in the finishing unit 15 may be 2, 4; 2, 3; and 5, 6.

FIG. *2c* illustrates two tiltable conveying means 7 and 12 cooperating with the doffing points 3 and 4. Conveying means 7 and 12 communicate with transport devices 8 and 14 to bring about an order 5, 6; 2, 4; and 2, 3 of superposed fibrous webs to be bonded in a nonwoven fabric. In the three variations of the sandwich arrangement, fibrous web 5, 6 is situated in the center, on the one hand, and at the top or bottom, on the other hand, while the fibrous webs from card 2 are exchanged in order relative to fibrous web 5, 6. It is also possible to provide a transport device 10 tiltable upwardly and downwardly, allowing additional variations concerning the fibrous web order in the final nonwoven fabric.

FIGS. *3a, 3b, 3c,* and *3d* show additional embodiments including an additional finishing unit 19 arranged at the other side of the card set. Care is taken for a return movement of the conveying means from the doffing points of the card 2 and also from doffing point 6 of card 5 to the finishing unit 19. Both conveying means 12 and 7 of the doffing points 4 and 3 may be optionally placed in contact with the upper additional transport devices 9 and 13, or with the lower transport devices 8 and 17. In connection with the embodiments selected in case of FIGS. *3a–3d,* the following variations in the order of the fibrous webs in the finishing unit are possible, as viewed from the top: FIG. *3a,* finishing unit 15, 5, 6; finishing unit 19, 2, 2 and 2, 3; FIG. *3b,* finishing unit 15, 2, 4, and 5, 6, finishing unit 19 2, 3: FIG. *3c,* finishing unit 15 only receiving fibrous web 2, 4, while finishing unit 19 gets fibrous webs 2, 3 in superposed order; and FIG. *3d,* finishing unit 15 receives the superposed fibrous webs 5, 6 and 2; 4 while fibrous web 2, 3 is fed to the finishing unit 19. Further variations may be realized in that tiltable conveying means 7 may be caused to contact additional transport device 13 extending to finishing unit 15.

FIGS. *4a, 4b, 4c, 4d, 4e,* and *4f* show cards having two doffing points each, viz. 2, 3, 4 and 2′, 3′ and 4′ in successive order. Tiltable conveying mean 7 and 12 of card 2 may optionally contact upper further transport devices 9 and 13 or lower transport devices 21 and 22. In the case of card 2′ having two doffing points 3′ and 4′, the fibrous webs may be further conveyed directly to the finishing unit 14, or, upon rerouting via additional transport devices 16 and 23 to finishing unit 19.

As evident from the illustrated embodiments of FIGS. *4a–4f,* the layers of the fibrous webs of the nonwoven fabric to be bonded may be sandwiched as follows:

FIG. *4a:* finishing unit 15, 2, 4; 2′ 4; 2′, 3′, and finishing unit 19, 3, 3.

FIG. *4b:* finishing unit 15, 2′, 4; 2′, 3′; 2, 4, and finishing unit 19, 2, 3, 2′, 3′.

FIG. *4c:* finishing unit 15, 2, 4; 2′, 4′, and finishing unit 19, 2, 3.

Figure 4A:
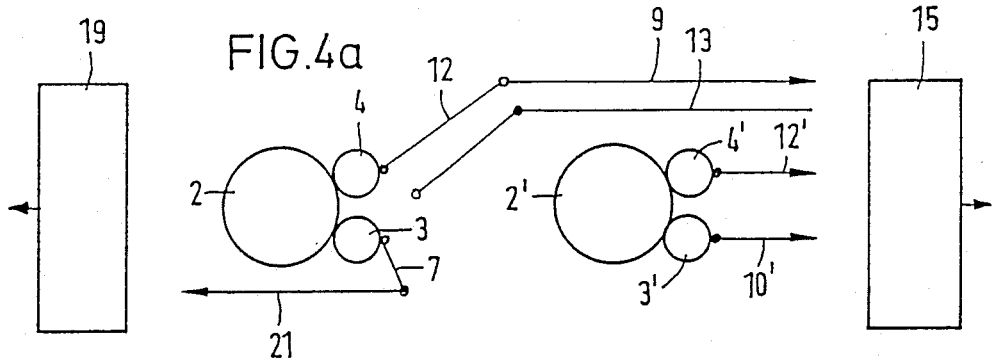
Figure 4B:
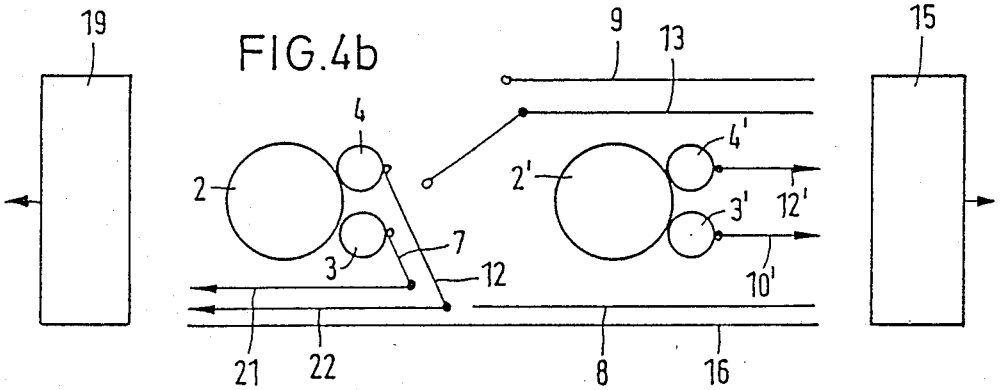
Figure 4C:
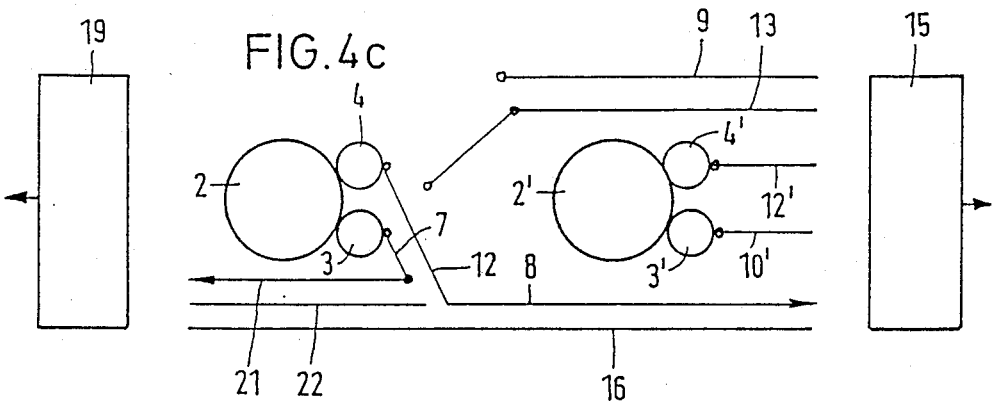
Figure 4D:
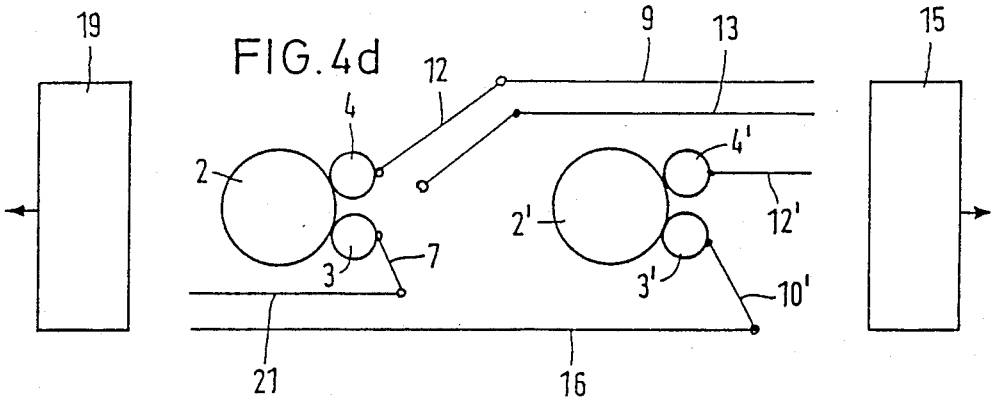
Figure 4E:
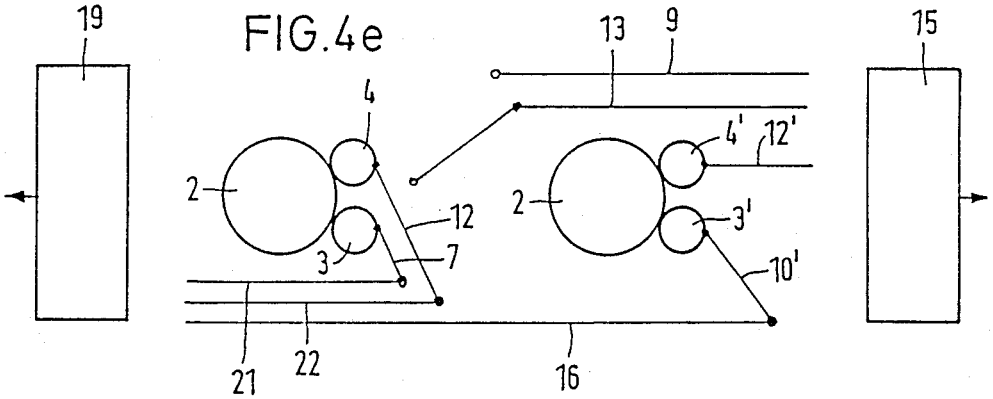

FIG. 4*d*: finishing unit 15, 2, 4, 2', 4', and finishing unit 10, 2, 3; 2, 4; 2', 3'.

Figure 4F:
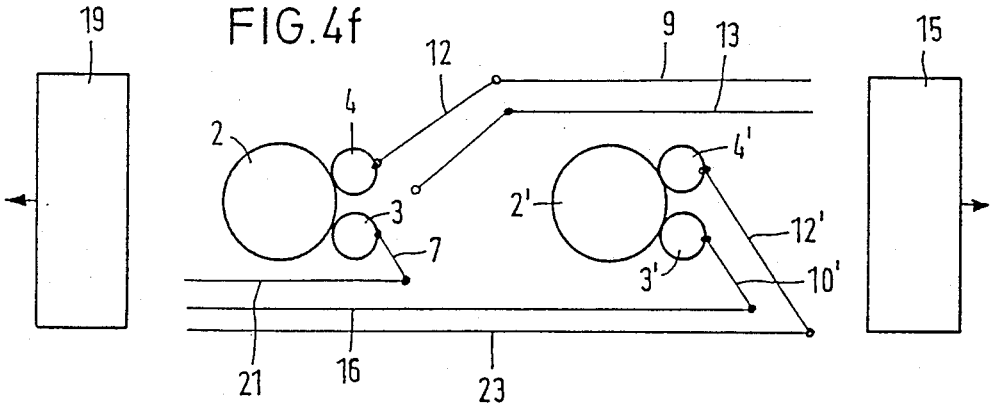

FIG. 4*f*: finishing unit 15, 2, 4, and finishing unit 19, 2, 3, 2', 3', 2', 4'.

The variations may be optionally increased, in that through additional transport device 13, tiltable conveying means 7 and 12 are connected to finishing unit 15.

FIG. 5 shows an advantageous embodiment which includes three cards 30, 31, 32 in successive order. Each card is provided with a feeding means 33, 34, 35, and with two doffing points 36, 37, 38, 39, and 40, 41. A continuous conveyor belt 42 extends beneath cards 30, 31, 32 and may be driven optionally in one direction or the other. Driving means 43 is connected by a transmission member 44 to drive the belts. At the ends of the card set 30, 31, 32, a respective finishing unit 46 and 47 is arranged. A conveyor belt 48 extends to the latter.

At the upper doffing points of cards 30, 31, 32, there are hinged pivotable conveying means 50, 51, and 52. The pivotable conveying means may swing in upward and downward directions by a predetermined angle. Another transport device 54 mounted above card 31 adjoins upwardly swivelled conveying means 50. Above card 32 is a similar additional transport device 55 extending from the final point of upwardly swivelled conveying means 51 to the finishing unit 46. Additional upper transport device 54 may be elongated to extend as far as to finishing unit 46. However, fibrous web delivered from card 30 may also be fed at point 56 to additional transport device 55 which supplies two superposed fibrous webs to the finishing unit.

The lower doffing points 37, 39, 41 communicate with conveying means 57, 58, 59 to guide the fibrous web to common conveyor belt 42. If the latter travels towards finishing unit 46, the fibrous webs supplied from the lower doffing points 37, 39, and 41 are fed on the common conveyor belt 42 to finishing unit 46. The common conveyor belt 42 may also move towards finishing point 47 to allow for the fibrous webs from the lower doffing points of cards 30, 31, 32 to travel to finishing unit 47. Further, conveyor belt 42 may be divided at the respective delivery points of conveying means 57, 58, and 59 so that, upon request, parts may be conveyed in one direction or in the opposite direction. Subject to the position of swivelled conveying means 50, 51, and 52, the fibrous webs may be delivered from the upper and/or lower doffing points in a varying order to finishing unit 46 or 47.

From conveyor belt 42 or the last part thereof, a transport belt 61 extends to finishing unit 46. Another conveyor belt 62 extends from the upper point of swivable conveying means 52 to conveyor belt 61. Belt 62 carries the fibrous web from the upper doffing point 40 of card 32 to conveyor belt 61. Conveying means 57, 58 and 59 may be also swivelled upwardly at a predetermined angle, if overlying upper conveying means 50, 51 and 52 are also swivelled upwardly. In this respect, it is possible to mount an additional transport device adjoined to upwardly swivelled conveying means 57, 58, 59 which further extend above the next cards and as far as to finishing unit 46.

The card by itself may be adapted to produce a fibrous web formed by fibers oriented in parallel or a web comprising randomly distributed fibers. In the card set, the order concerning the unit for webs having a parallel fiber orientation or for randomly distributed fibers, may be optional. The card may comprise, for instance, a cylinder 65 whose circumference may be provided with a plurality of working points 66*a*–66*d* in the form of workers and strippers. The cylinder 65 is fitted with two doffing points 68 and 69 which lead to conveyor belts 36 and 37. For a nonoriented web, a corresponding roller 70 may cooperate with the cylinder 65. An assembly comprising three cards having two respective doffing points each and being adapted to optionally guide fibrous webs to one finishing unit or to the other offers many variations for the sandwich formation of the fibrous webs to be finished. By swinging intermediate members of the conveying system or by mounting further transport devices, the sequence of the fibrous webs may be greatly varied thus obtaining, due to a considerable structural variety, nonwoven fabrics of different qualities and thicknesses.

While a preferred embodiment of the invention has been described using specific terms, such description is for illustrative purposes only, and it is to be understood that changes and variations may be made without departing from the spirit or scope of the following claims.

What is claimed is:

1. A process for producing nonwoven fibrous webs of at least two superposed layers of equal or different structure by using at least two successively arranged cards or the like and by discharging the fibrous webs from the cards, the discharged fibrous webs being supplied to a finishing unit or the like, such as a calendar, characterized by removing each fibrous web from said cards, and selectively feeding each said web in a direction below or above the web layer of the next card.

2. The process as set forth in claim 1, characterized by selectively discharging the fibrous web layer from each card or the like in an opposite direction to the successive card arrangement and feeding the discharged web to a finishing unit set up in the opposite direction.

3. The process as set forth in claim 1, characterized by doffing at least one of said cards at more than one doffing point.

4. The process as set forth in claim 1, characterized by successively arranging at least one of cards to produce webs having randomly oriented fibers.

5. The process for producing a nonwoven fibrous fabric having at least two superimposed fibrous web layers comprising:

arranging at least two cards successively in a card set wherein each card has at least one doffing point;

discharging said fibrous webs from said doffing point of said cards selectively in upward and downward directions to a transporting means;

transporting said discharge fibrous web selectively either above and below said cards with said transporting means which receives said fibrous webs from said doffing point; and transporting said fibrous web layers to a finishing unit and the like.

6. The process of claim 5 including selectively driving said transport means in opposite longitudinal directions.

* * * * *